US009845941B2

(12) United States Patent
Yang

(10) Patent No.: US 9,845,941 B2
(45) Date of Patent: Dec. 19, 2017

(54) LIGHTING ARRANGEMENT

(71) Applicant: Kuzco Lighting, Surrey (CA)

(72) Inventor: Shaokun Yang, Surrey (CA)

( * ) Notice: Subject to any disclaimer, the term of this patent is extended or adjusted under 35 U.S.C. 154(b) by 44 days.

(21) Appl. No.: 14/960,529

(22) Filed: Dec. 7, 2015

(65) Prior Publication Data

US 2017/0159918 A1 Jun. 8, 2017

(51) Int. Cl.

| | |
|---|---|
| ***F21V 15/00*** | (2015.01) |
| ***F21V 23/00*** | (2015.01) |
| ***F21V 15/01*** | (2006.01) |
| *F21Y 101/02* | (2006.01) |

(52) U.S. Cl.

CPC ..... *F21V 23/002* (2013.01); *F21V 15/01* (2013.01); *F21V 23/006* (2013.01); *F21Y 2101/02* (2013.01)

(58) Field of Classification Search

CPC ..... F21V 23/002; F21V 23/006; F21V 15/01; F21Y 2115/00; F21Y 2115/10; F21Y 2115/20

USPC ..... 362/362, 350

See application file for complete search history.

(56) References Cited

U.S. PATENT DOCUMENTS

| | | | |
|---|---|---|---|
| 734,167 | A | 7/1903 | Gaisman |
| 1,509,559 | A | 9/1924 | Jennings |
| D91,174 | S | 8/1933 | Mascuch |
| 2,516,661 | A | 7/1950 | Versen |
| 3,506,232 | A | 4/1970 | Wolar et al. |
| 3,561,652 | A | 2/1971 | Ruter |
| 3,799,429 | A | 3/1974 | Henry |
| 4,735,035 | A | 4/1988 | Mattioli |
| 4,973,370 | A | 11/1990 | Kreinberg |
| 5,018,969 | A | 5/1991 | Andreiko et al. |
| 5,036,166 | A | 7/1991 | Monopoli |
| D328,908 | S | 8/1992 | Kalbach |
| D329,309 | S | 9/1992 | Washington |

(Continued)

FOREIGN PATENT DOCUMENTS

| | | |
|---|---|---|
| CA | 2422087 A1 | 12/2002 |
| CA | 2586494 | 7/2010 |

(Continued)

OTHER PUBLICATIONS

USPTO; Office Action to Design U.S. Appl. No. 29/523,131; dated Oct. 5, 2016, 28 pgs.

(Continued)

*Primary Examiner* — Paultep Savusdiphol

(57) ABSTRACT

A lighting arrangement can include a first housing portion, a second housing portion, a first wire assembly, a driver board, a heat-shrinkable sleeve, a second negative wire, a second positive wire, and a light emitting diode with chip on board (LEDCOB). The first housing portion can be selectively engageable with one another through inwardly-directed threads and outwardly-directed threads to define an enclosed cavity extending along an axis. The first wire assembly can include a first positive wire, a first negative wire, and a ground wire. The driver board can be electrically coupled to the first positive wire and the first negative wire. The heat-shrinkable sleeve can enclose the driver board. The second positive wire and the second negative wire can be electrically coupled to the driver board and the LEDCOB.

6 Claims, 5 Drawing Sheets

(56) References Cited

U.S. PATENT DOCUMENTS

| | | | | |
|---|---|---|---|---|
| 5,722,758 | A | 3/1998 | Huang | |
| 5,802,828 | A | 9/1998 | Adorno | |
| 5,931,076 | A | 8/1999 | Ryan | |
| D418,811 | S | 1/2000 | Bunyea et al. | |
| D422,745 | S | 4/2000 | Losole | |
| D427,668 | S | 7/2000 | Stout | |
| D452,343 | S | 12/2001 | Pan | |
| 7,086,767 | B2 | 8/2006 | Sidwell et al. | |
| 7,153,167 | B1 * | 12/2006 | Switzer | H01R 33/22 439/537 |
| 7,234,842 | B2 | 6/2007 | Frederico | |
| 7,240,599 | B2 | 7/2007 | Nolan | |
| 7,311,425 | B2 | 12/2007 | Jervey, III | |
| D570,036 | S | 5/2008 | Conroy | |
| D599,053 | S | 8/2009 | Scott | |
| 7,591,675 | B2 * | 9/2009 | Ratican | H01R 33/94 439/531 |
| 7,628,504 | B2 | 12/2009 | Glickman | |
| 7,652,211 | B2 | 1/2010 | Globus et al. | |
| 7,666,036 | B1 | 2/2010 | Zou | |
| D612,979 | S | 3/2010 | Holsinger | |
| 7,965,023 | B1 * | 6/2011 | Liang | F21V 3/00 313/45 |
| 7,976,211 | B2 * | 7/2011 | Cao | F21V 3/02 362/649 |
| D647,862 | S | 11/2011 | Sieff | |
| 8,118,449 | B2 | 2/2012 | Pawelko et al. | |
| D658,328 | S | 4/2012 | Baldwin | |
| 8,376,777 | B2 | 2/2013 | Smith | |
| D679,253 | S | 4/2013 | Lin | |
| 8,410,699 | B2 | 4/2013 | Yu | |
| D710,536 | S | 8/2014 | Mollaghaffari | |
| D713,943 | S | 9/2014 | Luke | |
| D713,944 | S | 9/2014 | Luke | |
| 9,068,725 | B1 | 6/2015 | Kuykendall et al. | |
| 2002/0182917 | A1 | 12/2002 | Kerr | |
| 2006/0274536 | A1 | 12/2006 | Hagen | |
| 2007/0127234 | A1 | 6/2007 | Jervey | |
| 2008/0278958 | A1 | 11/2008 | Jiang | |
| 2009/0241854 | A1 | 10/2009 | Hurwitz | |
| 2010/0296300 | A1 | 11/2010 | Chiu | |
| 2011/0206974 | A1 * | 8/2011 | Inoue | H01M 4/043 429/149 |
| 2011/0242814 | A1 | 10/2011 | Markle et al. | |
| 2012/0156552 | A1 * | 6/2012 | Miyazaki | H01M 2/22 429/179 |
| 2012/0206921 | A1 * | 8/2012 | Chang | F21K 9/00 362/311.02 |
| 2012/0272816 | A1 | 11/2012 | Ueda et al. | |
| 2013/0033872 | A1 | 2/2013 | Randolph et al. | |
| 2013/0039043 | A1 * | 2/2013 | Doyle | F21V 31/005 362/158 |
| 2013/0100651 | A1 * | 4/2013 | Doyle | F21L 4/00 362/158 |
| 2013/0107516 | A1 | 5/2013 | Chou | |
| 2013/0153731 | A1 | 6/2013 | Engstrom et al. | |
| 2013/0333943 | A1 | 12/2013 | Tanaka et al. | |
| 2013/0343050 | A1 * | 12/2013 | Hu | F21S 4/28 362/217.16 |
| 2014/0036517 | A1 * | 2/2014 | Machiorlette | F21V 21/008 362/387 |
| 2014/0071687 | A1 | 3/2014 | Tickner et al. | |
| 2014/0092606 | A1 | 4/2014 | Potucek et al. | |
| 2014/0268768 | A1 | 9/2014 | Holland et al. | |
| 2015/0129297 | A1 | 5/2015 | Hanazaki | |
| 2016/0155533 | A1 | 6/2016 | Omoto | |
| 2016/0209008 | A1 * | 7/2016 | Yang | F21V 21/104 |
| 2016/0245432 | A1 | 8/2016 | Fonfara et al. | |

FOREIGN PATENT DOCUMENTS

| | | | |
|---|---|---|---|
| CA | 2754514 | A1 | 4/2012 |
| CA | 2766601 | | 7/2014 |
| CN | 201129685 | Y | 10/2008 |
| DE | 3421599 | A1 | 12/1985 |
| DE | 10261305 | A1 | 7/2004 |
| EP | 1983255 | A1 | 12/2007 |

OTHER PUBLICATIONS

USPTO; Office Action to U.S. Appl. No. 14/601,301; dated Aug. 31, 2016, 37 pgs.

USPTO; Office Action to U.S. Appl. No. 14/725,062; dated Sep. 1, 2016, 31 pgs.

Stainless Steel Braided Sleeving www.cableorganizer.com. Cite crawled and recorded on Mar. 19, 2014, found at:http://www.tineye.com/search/70d87d79583e8760a052d08b8fb71 a2b9a0fc396/.

SY Steel Wire Braid Armoured Flexible PVC Control Cable: 2.5mm 3 Core www.uk.shopping.com. Cite crawled and recorded onNov. 11, 2009, found at: http://www.tineye.com/search/55aa23d9c74b66be84ef2784c9ec21 0255d01252/.

USPTO Notice of Allowance to U.S. Appl. No. 29/547,656, dated Jan. 4, 2017, 29 pgs.

* cited by examiner

LIGHTING ARRANGEMENT

BACKGROUND

1. Field

The present disclosure relates to a light-emitting device.

2. Description of Related Prior Art

U.S. Pat. No. 8,410,699 discloses a HEAT DISSIPATION ENHANCED LED LAMP. The abstract of the '699 patent indicates that a LED lamp which could directly replace an ordinary tungsten, halogen, or electricity-saving light bulb, includes a LED filament, a lamp base, a thermally conductive electric insulator, and a mask. The thermally conductive electric insulator is filled in a cavity of the lamp base, and includes a first portion mechanically contacting the LED filament and an electrode of the lamp base to provide a first thermal channel from the LED filament to the lamp base, and a second portion adhering the mask to the lamp base to provide a second thermal channel from the lamp base to the mask. By using the mask to enlarge the heat dissipation area, a better heat dissipation effect is achieved.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A lighting arrangement can include a first housing portion, a second housing portion, a first wire assembly, a driver board, a heat-shrinkable sleeve, a second negative wire, a second positive wire, and a light emitting diode with chip on board. The first housing portion can define a first aperture having a first portion with a first diameter positioned proximate to a first end of the first housing portion and a second portion with a second diameter positioned proximate to a second end of the first housing portion. The second diameter can be greater than the first diameter. The second housing portion can define a second aperture, a third aperture communicating directly with the second aperture, and a fourth aperture communicating directly with the second aperture. One of the first housing portion and the second housing portion can include radially inwardly-directed threads and the other of the first housing portion and the second housing portion can include radially outwardly-directed threads. The first housing portion and the second housing portion can be selectively engageable with one another through the inwardly-directed threads and outwardly-directed threads to define an enclosed cavity extending along an axis. The first wire assembly can pass into the cavity and can include a first positive wire, a first negative wire, and a ground wire. The driver board can be positioned in the cavity and electrically coupled to the first positive wire and the first negative wire. The heat-shrinkable sleeve can enclose the driver board and electrically insulate the driver board within the cavity from at least one of the first housing portion and the second housing portion and from the ground wire. The second positive wire can pass out of the cavity through the third aperture. The second negative wire can pass out of the cavity through the fourth aperture. The light emitting diode with chip on board (LEDCOB) can be mounted on an external surface of one of the first housing portion and the second housing portion. The second positive wire and the second negative wire can be electrically coupled to the LEDCOB.

BRIEF DESCRIPTION OF THE DRAWINGS

The detailed description set forth below references the following drawings.

DETAILED DESCRIPTION

Figure 1:
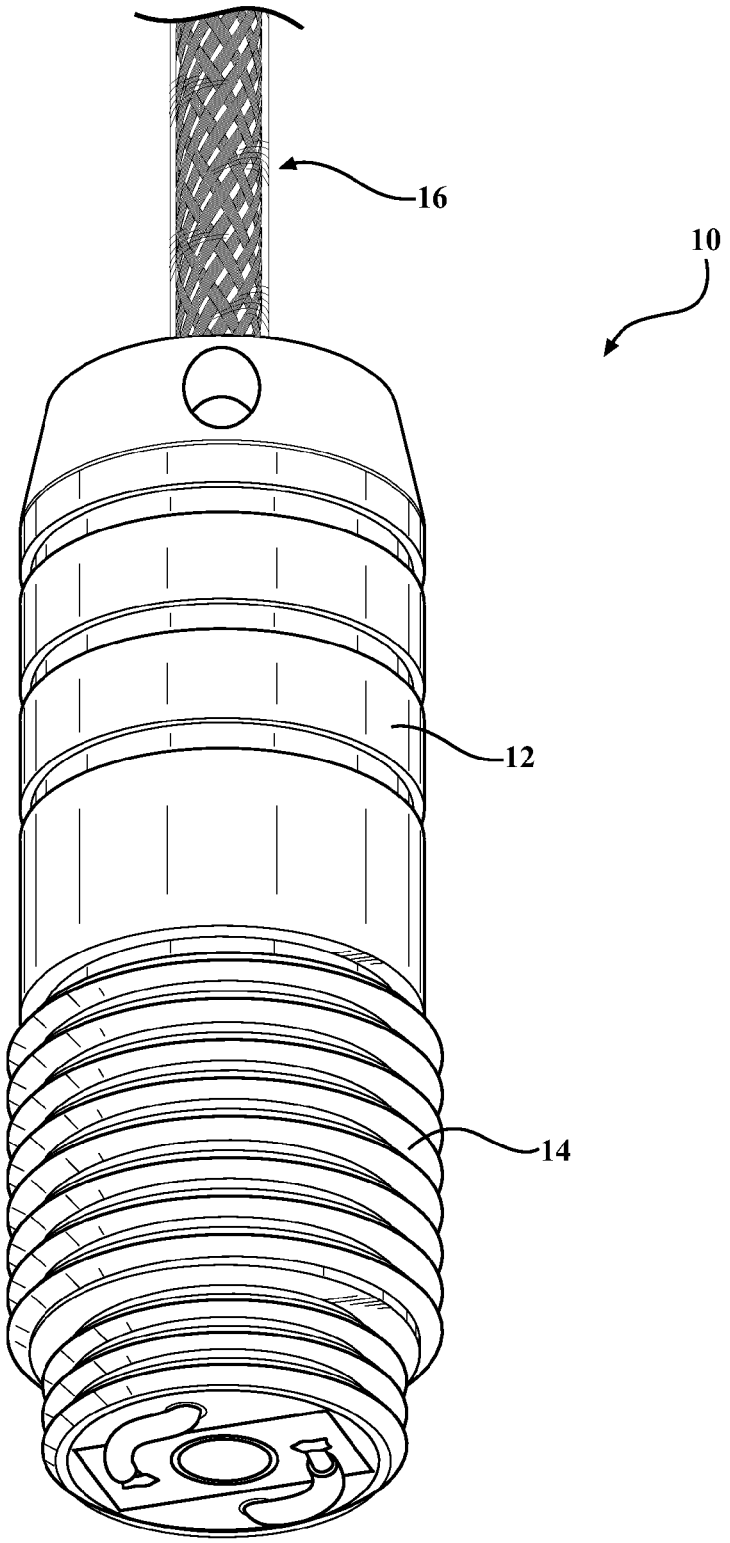
FIG. 1 is a perspective view of a lighting arrangement according to an exemplary embodiment of the present disclosure.
Figure 2:
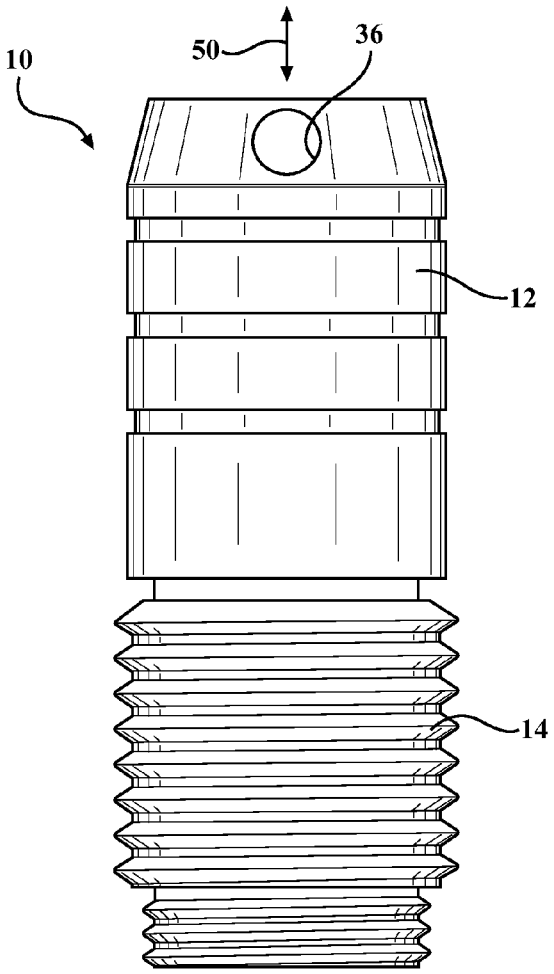
FIG. 2 is a front view of the lighting arrangement shown in FIG. 1.
Figure 3:
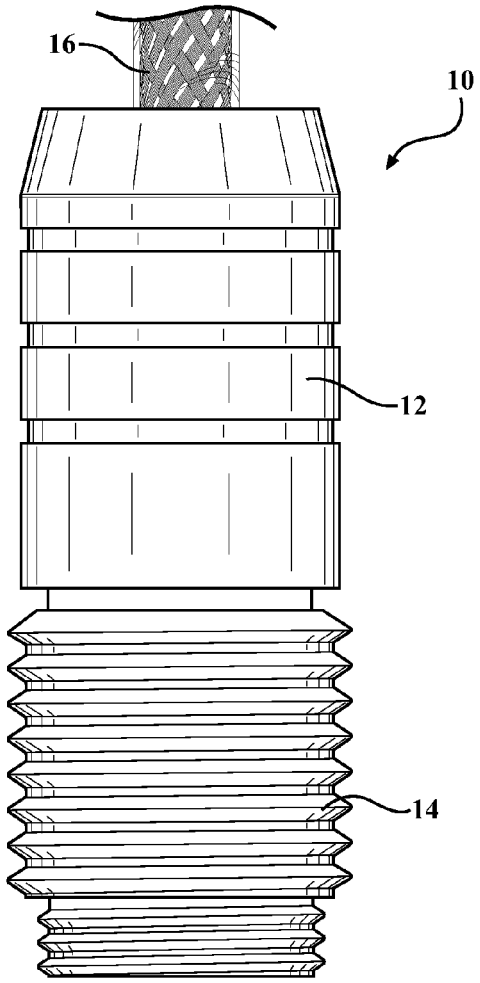
FIG. 3 is a rear view of the lighting arrangement shown in FIGS. 1 and 2.
Figure 4:
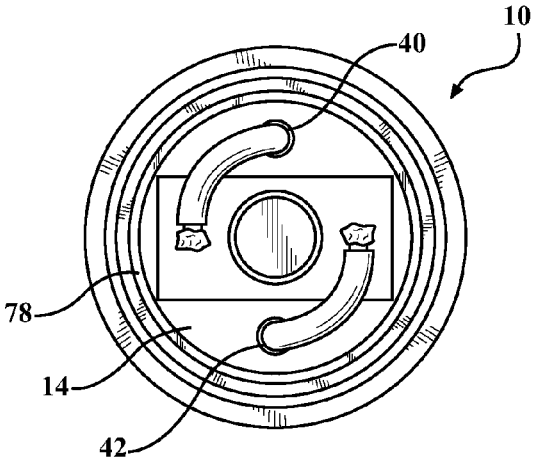
FIG. 4 is a right-side view of the lighting arrangement shown in FIGS. 1-3.
Figure 5:
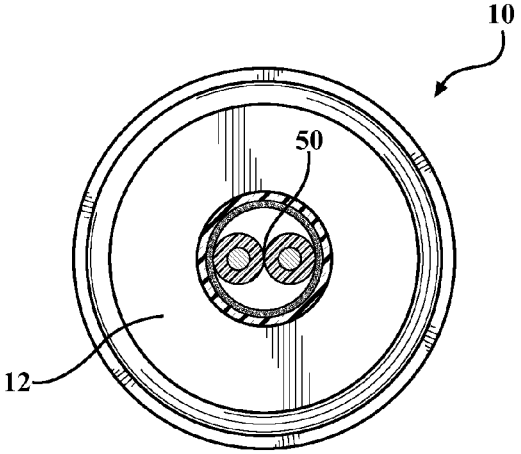
FIG. 5 is a left-side view of the lighting arrangement shown in FIGS. 1-4.

The present disclosure, as demonstrated by the exemplary embodiment described below, can provide a lighting arrangement. In an exemplary embodiment of the present disclosure, a lighting arrangement 10 can include a first housing portion 12, a second housing portion 14, a first wire assembly 16, a driver board 18, a heat-shrinkable sleeve 20, a second negative wire 22, a second positive wire 24, and a light emitting diode with chip on board (LEDCOB 26). The first housing portion 12 can extend between first and second opposite ends 32, 34 along a central, longitudinal axis 50. The first housing portion 12 can define a first aperture having a first portion 28 with a first diameter positioned proximate to the first end 32 of the first housing portion 12 and a second portion 30 with a second diameter positioned proximate to the second end 34 of the first housing portion 12. The second diameter can be greater than the first diameter. The first housing portion 12 can be formed from metal and can include an aperture 36. The aperture 36 can define inwardly-facing threads.

The second housing portion 14 can extend between first and second opposite ends 52, 54 along the axis 50. The second housing portion 14 can define a second aperture 38. The second housing portion 14 can also define a third aperture 40 communicating directly with the second aperture 38. The second housing portion 14 can also define a fourth aperture 42 communicating directly with the second aperture 38. The second housing portion 14 can be formed from metal and can also include an aperture 44. The aperture 44 can be a blind aperture and define inwardly-facing threads.

The exemplary first housing portion 12 can include radially inwardly-directed threads 46 at the second end 34. The second housing portion 14 can include radially outwardly-directed threads 48 at the first end 52. The first housing portion 12 and the second housing portion 14 can be selectively engageable with one another through the inwardly-directed threads 46 and outwardly-directed threads 48 to define an enclosed cavity 56 extending along the axis 50.

The first wire assembly 16 can pass into the cavity 56 and including a first positive wire 58, a first negative wire 60, and a ground wire 62. The first positive wire 58 can include a first wire member 64 enclosed in a first insulating sheath 66. The first positive wire 58 can be the "hot" wire of the lighting arrangement 10. The first negative wire 60 can include a second wire member 68 enclosed in a second insulating sheath 70. The first negative wire 60 can be the neutral wire of the lighting arrangement 10. The ground wire 62 can encircle both of the first positive wire 58 and the first negative wire 60. The ground wire 62 can be formed from a plurality of strands braided together. Each strand of the braid can be formed from a plurality of individual wires. The first wire assembly 16 can also include an insulating sheath 72 enclosing the ground wire 82. The ground wire 62 can be electrically coupled to one of the first housing portion 12 and the second housing portion 14 within the cavity 56 for grounding. In the exemplary embodiment of the present disclosure, the ground wire 62 can be connected to a clip 74 affixed to the aperture 44 with a screw 76. The ground wire 62 can be wound on itself to be attached to the clip 74, but can encircle both of the wires 58, 60 over substantially the remainder of its length.

Figure 8:
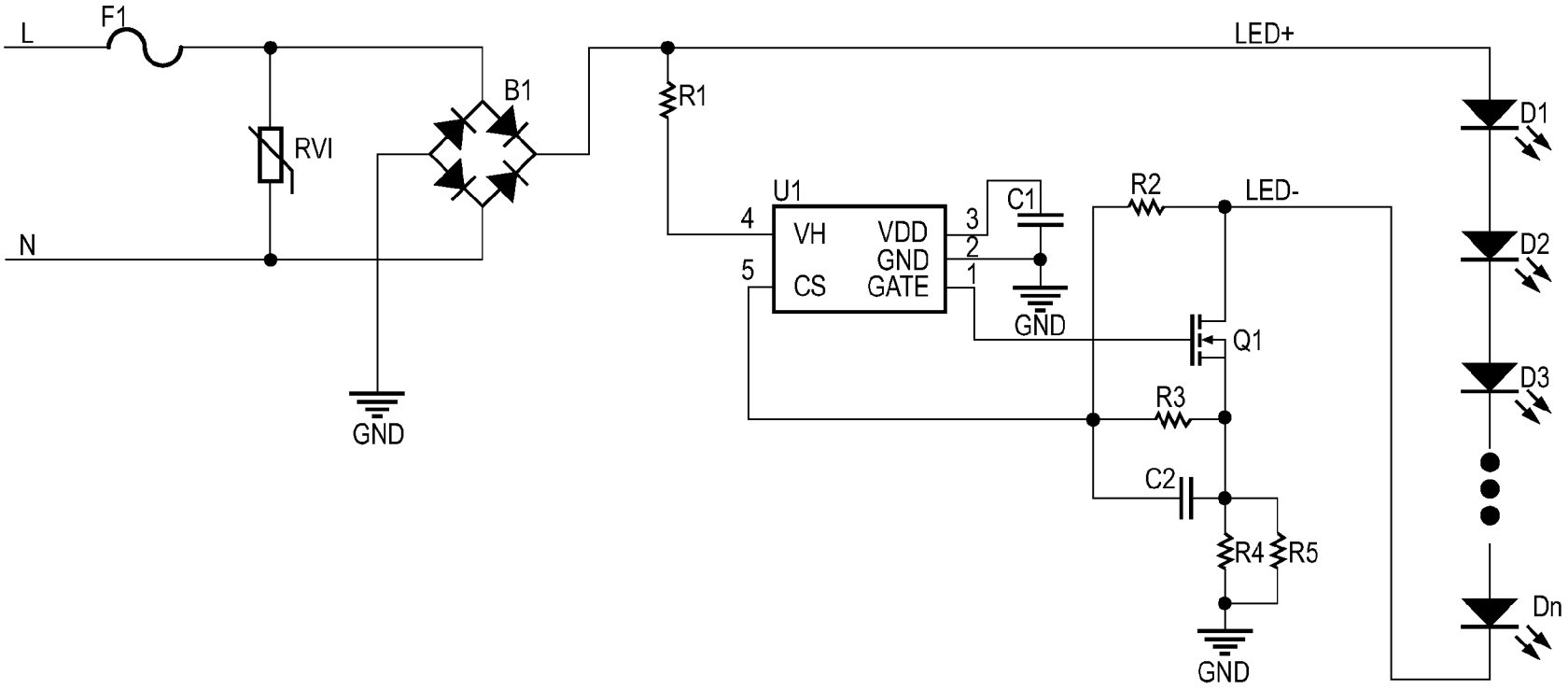
FIG. 8 is a circuit schematic of a driver board of the lighting arrangement shown in FIGS. 1-5.

The driver board 18 can be positioned in the cavity 56 and electrically coupled to the first positive wire 58 and the first negative wire 60. A schematic of the driver board 18 and the LEDs of the LEDCOB 26 is shown in FIG. 8. The heat-shrinkable sleeve 20 can enclose the driver board 18 and electrically insulate the driver board 18 within the cavity 56 from at least one of the first housing portion 12 and the second housing portion 14 and from the ground wire 62.

The second positive wire 24 can pass out of the cavity 56 through the aperture 40. The second negative wire 22 can pass out of the cavity 56 through the aperture 42. The light emitting diode with chip on board (LEDCOB 26) can be mounted on an external surface of one of the first housing portion 12 and the second housing portion 14. The second positive wire 24 and the second negative wire 22 can be electrically coupled to the LEDCOB 26. The driver board and the LEDCOB can be acquired from Zega LED Inc. of Surrey, British Columbia, Canada (part no. SCK 04-180-830-120-C1). The LEDCOB 26 can be in a recessed portion of the second housing portion 14. For example, the second housing portion 14 can include a rib 78 at the second end 54.

Figure 6:
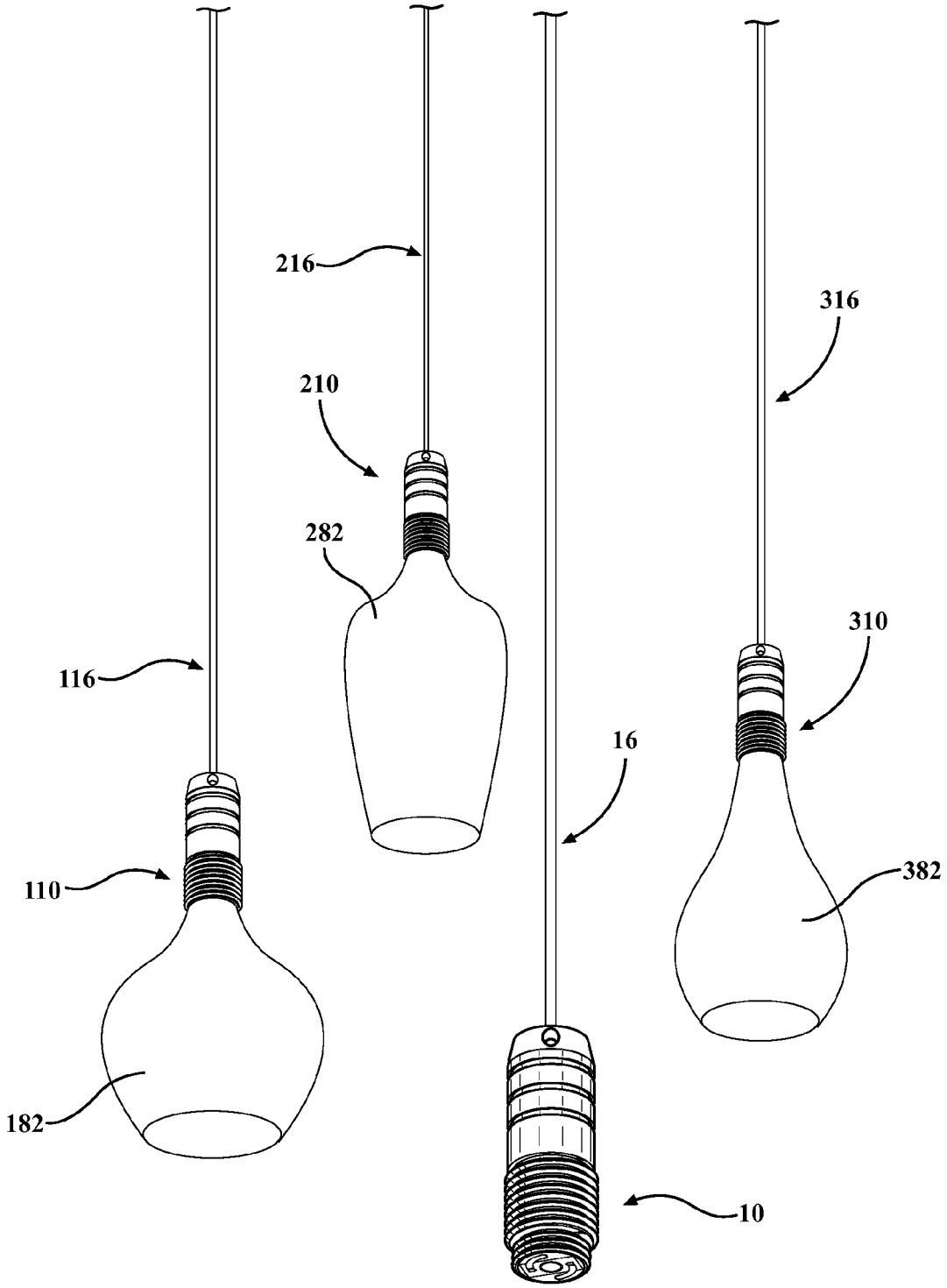
FIG. 6 is a perspective view of multiple examples of the lighting arrangement shown in FIGS. 1-5 in an exemplary operating environment.
Figure 7:
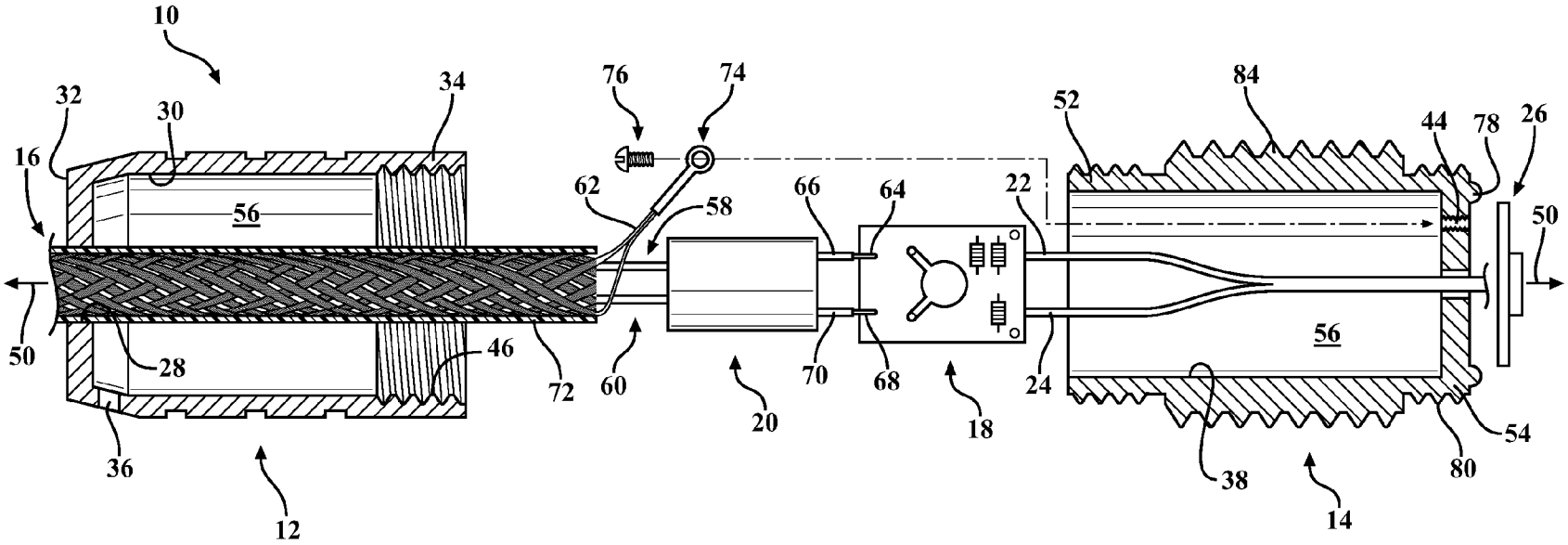
FIG. 7 is an exploded and partial cross-section of the lighting arrangement shown in FIGS. 1-5.

The second housing portion 14 can also include radially outwardly-directed threads 84 positioned proximate to the LEDCOB 26 along the axis 50. The threads 84 can be utilized to mount any one of a plurality of differently shaped globes to the lighting arrangement 10. FIG. 6 illustrates lighting arrangements 110, 210, and 310 respectively engaged with globes 182, 282, and 382. It is noted that lighting arrangements 110, 210, and 310 are substantially similar to lighting arrangement 10. FIG. 6 also illustrates the lighting arrangement 10 be utilized without a globe.

The second housing portion 14 can also include radially outwardly-directed threads 80 positioned immediately adjacent to the LEDCOB 26 along the axis 50. The threads 80 can be utilized to mount any one of a plurality of differently shaped globes to the lighting arrangement 10 having a different thread size than the thread size of the threads 84.

While the present disclosure has been described with reference to an exemplary embodiment, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the appended claims. Further, the "present disclosure" as that term is used in this document is what is claimed in the claims of this document. The right to claim elements and/or sub-combinations that are disclosed herein as other present disclosures in other patent documents is hereby unconditionally reserved.

What is claimed is:

1. A lighting arrangement comprising:

a first housing portion defining a first aperture, a first portion of the first aperture having a first diameter positioned proximate to a first end of said first housing portion, and a second portion of the first aperture having a second diameter positioned proximate to a second end of said first housing portion, and wherein said second diameter of the second portion of the first aperture is greater than said first diameter of the first portion of the first aperture;

a second housing portion defining a second aperture, a third aperture communicating directly with said second aperture, and a fourth aperture communicating directly with said second aperture;

wherein one of said first housing portion and said second housing portion includes radially inwardly-directed threads and the other of said first housing portion and said second housing portion includes radially outwardly-directed threads, said first housing portion and said second housing portion selectively engageable with one another through said inwardly-directed threads and outwardly-directed threads to define an enclosed cavity extending along an axis;

a first wire assembly passing into said cavity and including a first positive wire, a first negative wire, and a ground wire;

a driver board positioned in said cavity and electrically coupled to said first positive wire and said first negative wire;

a heat-shrinkable sleeve enclosing said driver board and electrically insulating said driver board within said cavity from at least one of said first housing portion and said second housing portion and from said ground wire;

a second positive wire passing out of said cavity through said third aperture and electrically coupled to said driver board;

a second negative wire passing out of said cavity through said fourth aperture and electrically coupled to said driver board; and a light emitting diode with chip on board (LEDCOB) mounted on an external surface of one of said first housing portion and said second housing portion, said second positive wire and said second negative wire electrically coupled to said LEDCOB.

2. The lighting arrangement of claim 1 wherein said ground wire is electrically coupled to one of said first housing portion and said second housing portion within said cavity.

3. The lighting arrangement of claim 2 wherein said second housing portion further comprises:

a first set of radially outwardly-directed threads positioned proximate to said LEDCOB along said axis.

4. The lighting arrangement of claim 3 wherein said second housing portion further comprises:

a second set of radially outwardly-directed threads positioned immediately adjacent to said LEDCOB along said axis.

5. The lighting arrangement of claim 4 wherein said first set of radially outwardly-directed threads and said second set of radially outwardly-directed threads are differently-sized.

6. The lighting arrangement of claim 5 wherein said ground wire is further defined as braided.

* * * * *